United States Patent [19]

Schaal et al.

[11] Patent Number: 4,939,801

[45] Date of Patent: Jul. 10, 1990

[54] PATIENT TRANSPORTING AND TURNING GURNEY

[76] Inventors: Gary A. Schaal; Diana L. Schaal, both of 11677 Hill Rd., Marysville, Calif. 95901

[21] Appl. No.: 288,650

[22] Filed: Dec. 22, 1988

[51] Int. Cl.[5] ..... A61G 7/00

[52] U.S. Cl. ..... 5/61; 5/81 R

[58] Field of Search ..... 5/61, 63, 81 R, 81 B, 5/86

[56] References Cited

U.S. PATENT DOCUMENTS

| | | | |
|---|---|---|---|
| 2,188,592 | 1/1940 | Cunningham . | |
| 2,690,177 | 9/1954 | Hogan . | |
| 2,908,916 | 10/1959 | Fischer | 5/86 |
| 3,226,734 | 1/1966 | Coventon . | |
| 3,238,539 | 3/1966 | Koch . | |
| 3,259,922 | 7/1966 | Fischer | 5/86 |
| 3,302,218 | 2/1967 | Stryker . | |
| 3,451,070 | 6/1969 | Danielson | 5/86 |
| 3,564,625 | 2/1971 | Danielson | 5/81 R |
| 3,815,164 | 6/1974 | Smith | 5/81 R |
| 3,827,089 | 8/1974 | Grow . | |
| 3,874,010 | 4/1975 | Geary . | |
| 4,244,358 | 1/1981 | Pyers . | |
| 4,356,577 | 11/1982 | Taylor | 5/81 R |

FOREIGN PATENT DOCUMENTS

| | | | |
|---|---|---|---|
| 0248537 | 12/1987 | European Pat. Off. | 5/63 |
| 791562 | 9/1935 | France | 5/61 |
| 359837 | 3/1962 | France | 5/61 |
| 2507471 | 12/1982 | France | 5/81 R |
| 685883 | 1/1953 | United Kingdom | 5/61 |

OTHER PUBLICATIONS

"Amerilift ® Patient Handling System".

*Primary Examiner*—Gary L. Smith
*Assistant Examiner*—F. Saether
*Attorney, Agent, or Firm*—Townsend and Townsend

[57] ABSTRACT

An improved patient transporting and turning gurney is disclosed for receiving and lifting a patient from a hospital bed, for transporting and depositing the patient on a hospital operating table, and for lifting and turning a patient for surgery. Preferably, the gurney has a U-shaped base, this base of sufficiently small dimension to fit under a hospital bed and of sufficiently large dimension to straddle the sides of a conventional operating table pedestal. The gurney further includes an overlying stretcher support, preferably U-shaped, for supporting a rotatable stretcher frame. A longitudinally extending rotating stretcher frame is mounted for rotation about its longitudinal axis on the stretcher support. Extending from the U-shaped base to the overlying stretcher support, there is provided a lifting device for moving the stretcher support upwardly and downwardly relative to the base. A system of patient attachment to the stretcher frame is disclosed in which two tensile supported sheet members can be detachably supported from the frame.

9 Claims, 4 Drawing Sheets

PATIENT TRANSPORTING AND TURNING GURNEY

FIELD OF THE INVENTION

This invention relates generally to devices used to move and position patients in hospitals. More specifically, the invention relates to a device used to lift, transport, and turn a patient in a hospital.

BACKGROUND OF THE INVENTION

Many of the procedures and treatments in a hospital require that a patient be lifted from a hospital bed, transported from the hospital bed and be deposited at another location, such as an operating table. In addition to such movement, it is frequently required that the patient be lifted and turned for treatments, such as an operation on the back.

There exist devices which lift and transport a patient but are incapable of turning or inverting a patient. There are also devices which turn or invert a patient, but are incapable of lifting or depositing a patient on an operating table.

An example of a device which can lift and transport a patient is the Amerilift® Patient Handling System. However, this device is incapable of turning or inverting a patient.

Detachable sheets are known in the art, see reference to Amerilift® Patient Handling System. Detachable sheets have straps attached to the backside to allow a patient supported thereon to be lifted by attaching the sheet to a lifting frame. Detachable sheets in and of themselves cannot safely and conveniently invert a patient.

Prior art methods for turning or inverting a patient fall into three broad classifications: (1) Manual methods, (2) Weaving methods, and (3) Clamshell methods.

First, the manual method requires numerous orderlies or staff members to physically pickup and invert a patient. It is especially difficult if the patient has been sedated, as is usual before surgical procedures. In the course of being physically inverted by numerous orderlies, the safety of the patient can be jeopardized as by crimping the tubes used for life support during intubation, as well as increasing the risk of injury to the orderlies who are inverting the patient. This is the common method employed to lift, deposit, and invert a patient who is intubated and sedated, and prepared for surgery on the back. Additionally for back surgery, a patient must be positioned on a positioning device such as a Wilson Frame to align the back properly. Proper positioning of the patient on the Wilson Frame is difficult through use of the manual method.

The second prior art method entails the use of devices which essentially weave a patient to a rotating frame, and after the frame is rotated, the patient is inverted. One implementation of these devices is to place a patient upon a first layer of the weave, the underneath layer, either through the assistance of the then conscious patient, or through use of the manual method described above. After the patient is positioned on the first layer, a second layer is added, interweaving straps of the first layer. Thus a patient is secured to a frame. After the frame is rotated, the patient is inverted. Such devices are not able to deposit the patient onto a bed or operating table. A common implementation of this device is its use to turn patients to be treated for burns.

Examples of devices in the second category of prior art devices are; U.S. Pat. Nos. 2,188,592 to Cunningham, 3,827,089 to Grow, 3,226,734 to Coventon, and 3,874,010 to Geary, all of which show devices designed to turn a patient once the patient is laying on the device. As noted above, these devices cannot lift or deposit a patient on a bed or operating table.

Devices in the third category, the clamshell method, invert a patient by trapping a patient between two rigid or semi-rigid structures, and then rotating the structures and the patient trapped therebetween. Again, these devices are incapable of lifting a patient, or depositing the patient once the patient is inverted. Therefore, as in the weave method described above, a patient must either assist in being positioned on the device, or recourse must be had to the manual method to position the patient.

Examples of prior art devices which utilize the clamshell method are; U.S. Pat. Nos. 2,690,177 to Hogan, 3,238,539 to Koch, 3,302,218 to Stryker, 3,827,089 to Grow, and 4,244,358 to Pyers.

OBJECTS AND ADVANTAGES

It is therefore one object of the present invention to provide an improved patient transporting and turning gurney for receiving and lifting a patient from a hospital bed, for transporting and depositing the patient on a hospital operating table, and for lifting and turning a patient for procedures or treatments requiring the patient to be inverted.

It is another object of the present invention to perform the previously described functions conveniently, securely, and with safety.

SUMMARY OF THE INVENTION

An improved patient transporting and turning gurney is disclosed for receiving and lifting a patient from a hospital bed, for transporting and depositing the patient on a hospital operating table, and for lifting and turning a patient for surgery. Preferably, the gurney has a U-shaped base, this base of sufficiently small dimension to fit under a hospital bed and of sufficiently large dimension to straddle the sides of a conventional operating table pedestal. The gurney further includes an overlying stretcher support, preferably U-shaped, for supporting a rotatable stretcher frame. A longitudinally extending rotating stretcher frame is mounted for rotation about its longitudinal axis on the stretcher support. Extending from the U-shaped base to the overlying stretcher support, there is provided a lifting device for moving the stretcher support upwardly and downwardly relative to the base. A system of patient attachment to the stretcher frame is disclosed in which two tensile supported sheet members can be detachably supported from the frame. This detachable support typically occurs from belts having hooks at one end attached to loops in the tensile sheet members. The belts at the end opposite the hooks attach to normally closed clamping buckles and are normally contained within the buckles between the hooks and a stop at the belt ends. In operation, a tensile sheet is typically placed under the patient in a hospital bed, usually with the assistance of the then conscious patient. The gurney is then registered to the bed by moving the base under the hospital bed and rotating and lowering the stretcher frame to surround both the sheet underlying the patient and the patient on the sheet. Belts from the frame at the buckles are hooked into the loops on the sheet and then placed under tension and are in sufficient number to fix the sheet to the frame at the normally closed buckles and support the patient. The frame is lifted with the supported patient and the gurney is used to deposit the patient for sedation on an operating table. Once sedated, and typically intubated, the patient has a second tensile sheet member placed over the patient and threaded to the frame by the belt members of the normally closed buckles. This second tensile sheet member effectively sandwiches the patient to the stretcher frame, firmly and safely holding the intubated patient to the stretcher frame. Thereafter, the stretcher frame is lifted, rotated on the stretcher supporting frame, and the patient inverted. Once the patient is inverted, the overlying tensile sheet is removed, the patient lowered on the underlying sheet to a position of support on a conventional operating table, the sheet unhooked and the frame removed. Return of the patient from the operating table constitutes reversal of the disclosed procedure using the tensile sheet member underlying the patient. Complementary brakes and latches are disclosed for arresting stretcher rotation and restraining stretcher support rotation to the usual horizontal position for patient pickup and discharge.

DETAILED DESCRIPTION OF A SPECIFIC EMBODIMENT

Figure 1:
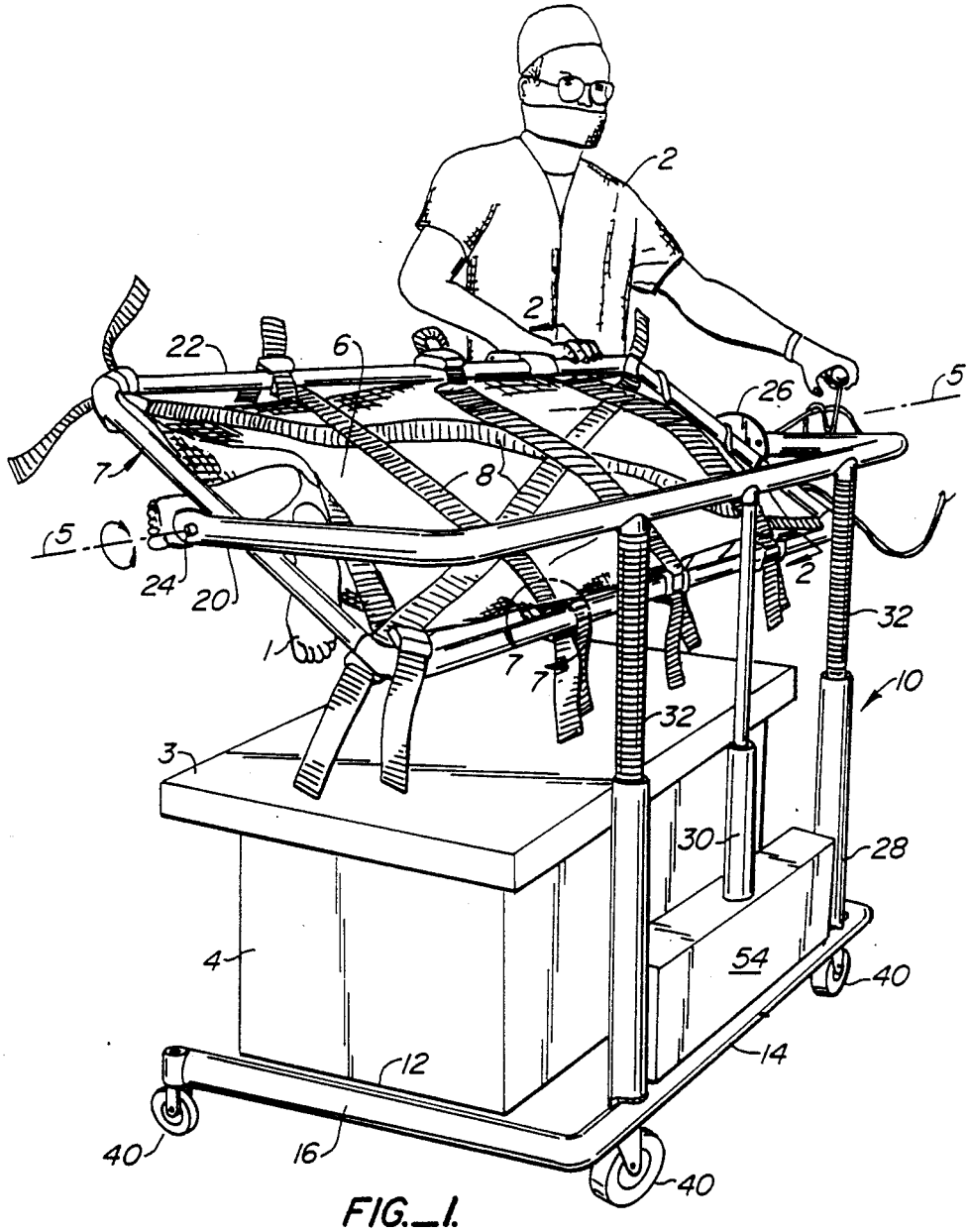
FIG. 1 is a perspective view showing the operation of an improved lifting and turning gurney implementing the preferred embodiment of the present invention, the figure depicting a patient that has just been lifted from an operating table after the patient has been intubated and sedated, the patient shown elevated from the operating table, snugly enclosed between underlying and overlying tensile sheet members used in the process of inverting the patient as performed by a single orderly or nurse.
Figure 2:
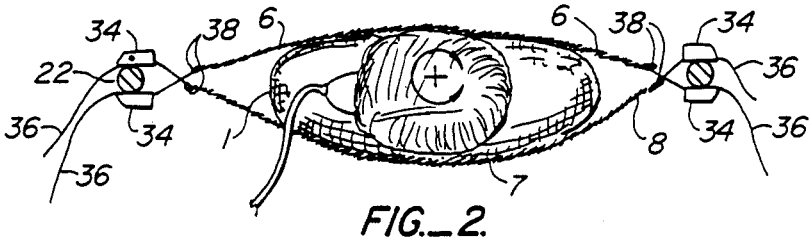
FIG. 2 is a detail sectional perspective view as viewed longitudinally along a patient's length from the patient's head which clearly indicates an example of the system of attachment of the underlying and overlying tensile sheet members to a rotatable stretcher frame such that the sheet members support all points of the patient's body, including the head as it faces to the side, with the sheet members further providing a "hammock effect" which centers the patient along the longitudinal axis of rotation of the rotatable stretcher frame.
Figure 7:
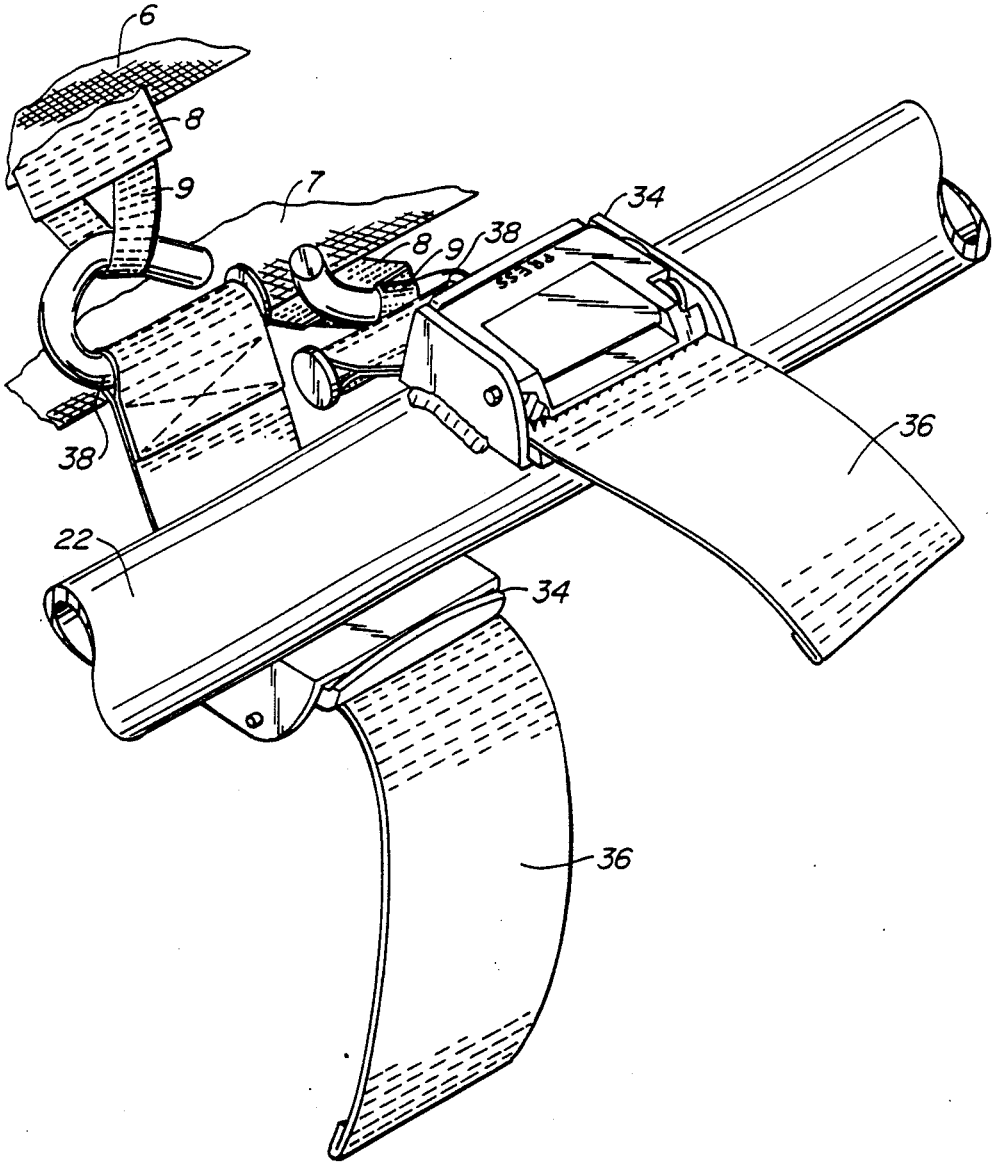
FIG. 7 is a detail view of the configuration of a set of buckles which form part of the system of attachment of the present invention and the attachment of the set of buckles to tensile sheet members as indicated in FIG. 1.

Now, with reference to FIGS. 1, 2 and 7, a specific embodiment of the present invention will be described. A patient 1 is being turned by a single nurse 2 by using an improved patient transporting and turning gurney 10 embodying the present invention. As will be described later, the patient 1 has been deposited on an operating table 3 and intubated and sedated. The patient 1 has next been secured to the turning gurney 10 by enveloping the patient 1 between an underlying sheet 6 and an overlying sheet 7. The patient 1 has been lifted from the operating table 3 and a detent mechanism 46 is released to allow a rotatable stretcher frame 22 to rotate and thus invert the patient 1. After the patient has been inverted, the now overlying sheet 6 is removed and the patient 1 is lowered back onto the operating table 3 and a Wilson Frame (not shown), with the now underlying sheet 7 remaining under the patient during the treatment. To return the patient 1 to hospital bed 52, the above described procedure is preformed, but in reverse.

Figure 4:
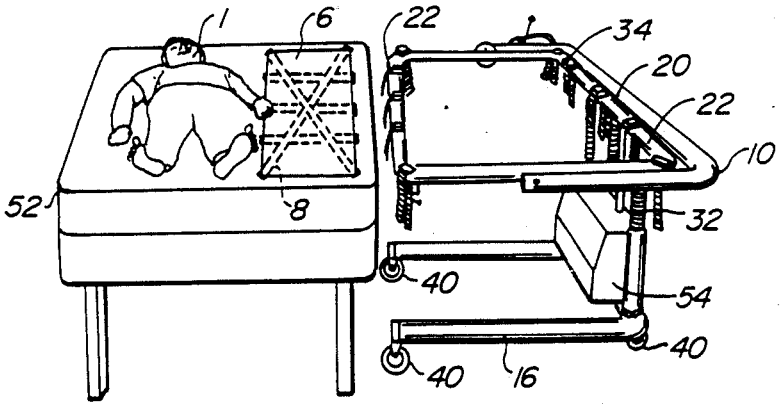
FIG. 4 is an illustration showing initial preparation to employ the gurney of the present invention wherein a detachable tensile sheet member is placed beside a patient while the patient lays in their hospital bed and the gurney is positioned next to the bed in anticipation of lowering the stretcher support and surrounding both the patient and the sheet by a rotatable stretcher frame for attachment of the sheet to the stretcher.
Figure 5:
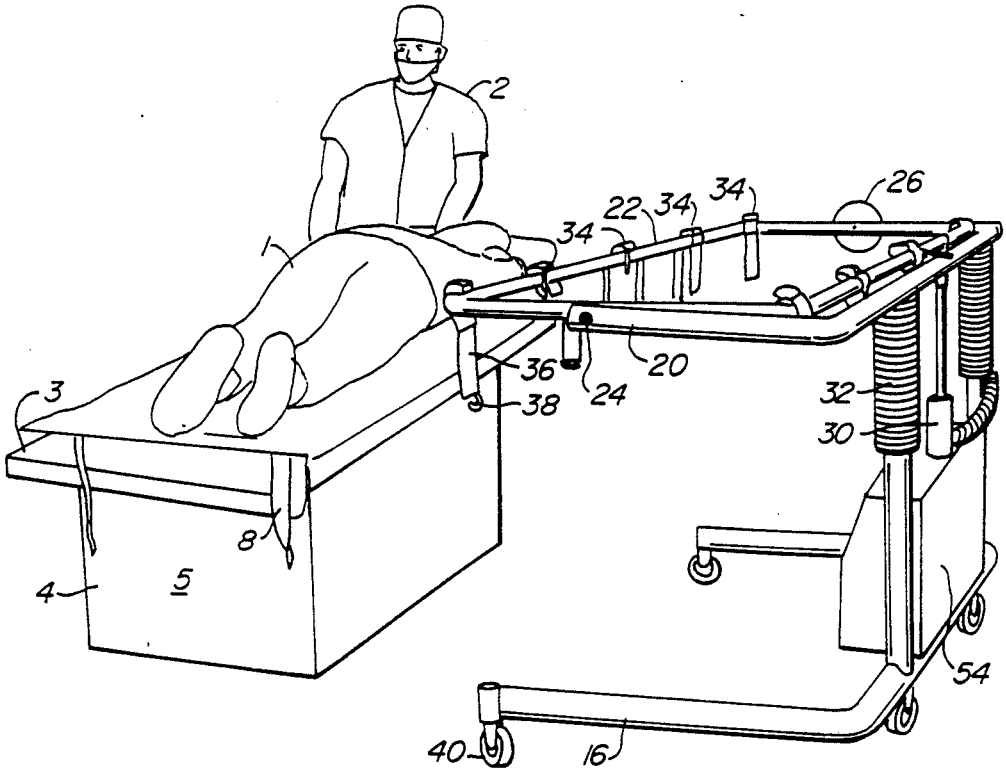
FIG. 5 is a perspective view depicting the turning operation depicted in FIG. 1 slightly later in time, with the patient inverted and deposited on an operating table, by being lowered onto a positioning device (not shown) on the operating table, and having the detachable tensile sheet members disengaged from the turning gurney, with the turning gurney withdrawn from the operating table so that treatment procedures may be performed on the back.
Figure 6:
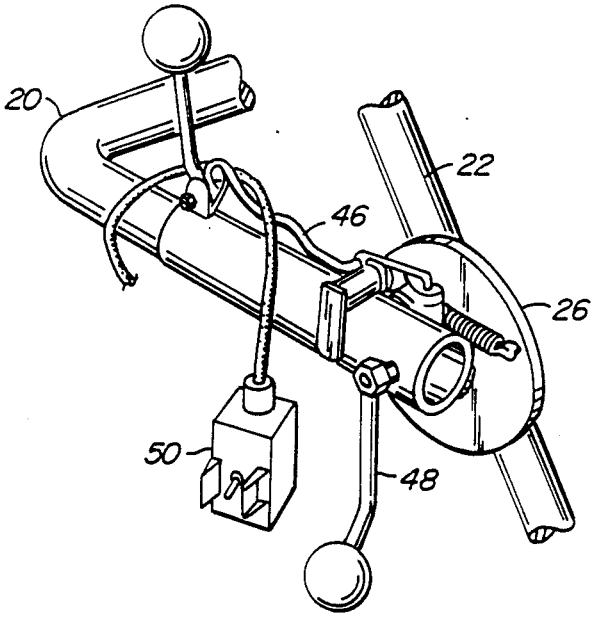
FIG. 6 is a detail view of the braking and detent mechanism used in the preferred embodiment, the braking mechanism used to slow or stop rotation of the rotatable stretcher frame about its pivot points on the stretcher support, and the detent mechanism used to lock the rotatable stretcher frame in either horizontal position, and a control device for controlling the elevation of the stretcher support.

The gurney 10 has a base 12, preferably U-shaped, and having a length for base member 14 sufficiently short to fit inside the legs of a hospital bed 52 as shown in FIG. 4. The length of the base member 14 is sufficiently long to straddle the sides of the pedestal base 4 of the operating table 3. The base 12 has arm members 16 and 18 of sufficient length to give stability to the gurney 10 and to allow the gurney 10 sufficient reach over a hospital bed 52 or operating table 3. There is provided on the bottom of base 12 a plurality of casters 40 to allow the base 12 to be moved easily from location to location.

Gurney 10 further includes an overlying stretcher support 20, which is preferably U-shaped, to support a rotatable stretcher frame 22. The stretcher support 20 is longer than the typical length of a patient 1 and may be of different length than base member 14 over which the length of the stretcher support 20 runs.

The stretcher frame 22 is generally rectangular, and having dimensions sufficiently long and sufficiently wide to comfortably surround a typical patient, that is to allow a patient to fit within its perimeter.

The rotatable stretcher frame 22 is mounted for rotation about its longitudinal axis such that the axis will correspond to an axis of rotation 5 of the stretcher support 20 defined as running through pivot points 24 and 26.

Figure 3:
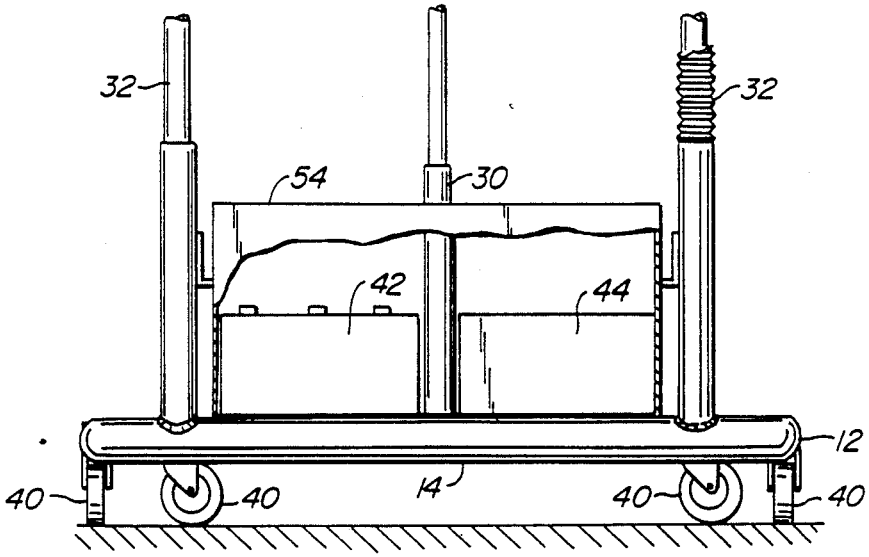
FIG. 3 is a perspective view taken from the back of the gurney which shows the configuration of the elements of the lifting device used with the present invention, and a cut-away indicating the rechargeable battery and hydraulic pump used in the present invention.

Extending from the U-shaped base 12 to the overlying stretcher support 20, is a lifting device 28 for moving the stretcher support 20 upwardly or downwardly relative to the base 12. The lifting device 28 has a ram 30 and two stand tubes 32. The ram 30 and stand tubes 32 are attached to the base member 14, and mounted between them is a compartment 54 holding other elements of the lifting device 28. Reference to FIG. 3 shows the other elements of the lifting device 28. A rechargeable battery 42 and hydraulic pump 44 are disposed within the compartment 54 as well as a hydraulic fluid reservoir (not shown). The elements of the lifting device 28 are described as only one possible embodiment of a lifting device 28 for illustration purposes only and not by way of limitation as it would be notoriously well known to persons of ordinary skill in the art to employ alternative designs to accomplish lifting. The specifics of the operation of the lifting device 28 will be described later, but the fundamental principles of its operation are notoriously well known and will not be described herein.

A system of attachment of patient 1 to the rotatable stretcher frame 22 will next be described by reference to FIGS. 7, 4, and 2. Used in the system of attachment is a specially fabricated tensile sheet member, an example would be sheet member 6 of FIG. 1 and 4. A sheet member is constructed of sturdy material, such as heavy canvas. Attached to a backside of the sheet member 6 is a configuration of five straps 8 that define a supporting configuration. Two straps 8 run diagonally, one strap 8 per diagonal, thereby forming an "X" on the backside. Three straps 8 run across the width of the tensile sheet member 6, one strap 8 runs across the sheet member 6 where the two diagonal straps 8 cross. The remaining straps 8 run across the width of sheet member 6 equidistant from the center and an outside edge of the sheet member 6. The five straps 8 thereby form a web which is used to support the sheet, and ultimately the patient laying upon the sheet. Each end of the five supporting straps 8 has a loop sewn therein adjacent and slightly inside of the outside edge of the sheet member. Thus there are a total of ten loops each sewn at the edge of sheet member 6. The configuration disclosed is the preferred embodiment, but it being understood that other configurations of straps 8 could be used by a person of ordinary skill in the art in embodiments of the present invention.

The attachment system utilizes two tensile supported sheet members 6 and 7 of the type described which sheet members can be detachably supported from the stretcher frame 22. This detachable support typically occurs from the straps 8 supporting under tension the tensile sheet members 6 and 7 from normally closed clamping buckles 34. Threading of the strap 8 to a buckle 34 will be described by reference to FIG. 7.

Through each of the normally closed buckles 34, there is provided a belt 36 for connecting a tensile sheet member 6 or 7 to the rotatable stretcher frame 22. Provided in an end of belt 36 which is normally interior to the stretcher frame 22 is a removable hook 38. Removable hook 38 is to be hooked into a loop 9 of the strap 8 on the sheet member, the looping being slightly inside the outside edge of the sheet. Buckles on a first surface and a second surface of rotatable stretcher frame 22 are slightly displaced from one another in a longitudinal direction, at least the width of a belt 36. The above description contemplates only one set of normally closed buckles 34. It is understood that the above description for a set of buckles 34 is to be repeated around the perimeter of the rotatable stretcher frame 22 at least as many times as the total number of loops 9 on a single sheet member 6 or 7, therefore there being a total of ten buckle 34 sets for the preferred embodiment.

Next, the operation of the turning gurney 10 will be described. In FIG. 4, a patient 1 is lying on a hospital bed. A first tensile sheet member 6 is laid beside the patient 1, and usually with the assistance of the patient 1 the tensile sheet 6 is placed underneath. The gurney 10 is then registered to the bed by moving the base 12 under the hospital bed and rotating and lowering the stretcher frame 22 to surround both the tensile sheet 6 and the patient 1. Straps 8 hooked to the loops of tensile sheet 6 are connected to the stretcher frame 22 by threading the straps 8 of the sheet member 6 to the buckles 34 on the upper surface of the rotatable stretcher frame 22. As described above, the threading is accomplished by connecting the removable hooks 38 in each of the belts 36 provided in each of the normally closed buckles 34 to loops 9 of the straps 8 of the first tensile sheet 6. Free ends of belts 36 are pulled to apply tension to the straps s, and thereby to the tensile sheet 6.

After the sheet member 6 underlying the patient 1 is secured to the rotatable stretcher support 22, the stretcher support 20 is lifted by use of the lifting device 28, thereby lifting the patient 1. The patient 1 is transported into an operating room wherein the patient 1 is deposited onto an operating table 3. The patient 1 is deposited by positioning the turning gurney 10 next to the operating table 3 by having the base member 14 of the base 12 straddle the sides of the operating table pedestal 4, and then lowering the patient onto the operating table 3. The patient 1 is then covered with a second sheet member 7. This sheet member 7 is supported under tension from the buckles 34 on the lower surface of the rotatable stretcher frame 22 similarly to the threading of sheet member 6 to the upper buckles 34 located on the upper surface of the rotatable stretcher frame 22. The patient 1 is again lifted and the detent mechanism 46 is released to allow the rotatable stretcher frame 22 to be rotated and thereby to invert the patient 1. The detent mechanism is locked to prevent further rotation of the rotatable stretcher frame 22 when the frame 22 is horizontal, and the patient 1 is facing down. With the patient now inverted, the overlying sheet member, now sheet 6, is removed by releasing latching means on the normally closed buckles 34 on the lower surface of the stretcher frame. This is followed by lowering the frame for support of the patient on a conventional operating table, detaching the underlying sheet from the frame, and removal of the frame. To return the patient to a hospital bed, the process is reversed.

What is claimed is:

1. A gurney for moving a hospital patient between a hospital bed having widely spaced supporting legs and an operating table supported from a central pedestal base, said gurney comprising:

a base, said base being horizontally disposed and U-shaped, said U-shaped base having spaced apart protruding arms connected by a central member, said spaced apart arms adapted to fit under and between the supporting legs of the hospital bed and straddle around the outside of the central pedestal base of the operating table;

said base supporting a plurality of wheels whereby said base can be rolled from support underneath the hospital bed to support around the central pedestal base of the operating table;

a stretcher support;

means for supporting said stretcher support from said base including a lifting ram connected to the base at the lower end and to the stretcher to support at the upper end whereby the stretcher support may be raised and lowered with respect to the base;

a stretcher frame elongate about a central longitudinal axis, said stretcher frame disposed for surrounding and supporting a patient within said stretcher frame;

means for rotatably connecting said stretcher frame to said stretcher support at the longitudinal axis of said stretcher frame, said means for rotatably connecting said stretcher frame to said stretcher support permitting the rotating of said frame about said longitudinal axis between distal ends of said stretcher support;

first and second tensile sheet members for being disposed on said patient at opposite sides of said patient, each said tensile sheet member being sufficiently strong to support said patient from said stretcher frame under tension;

first means for detachably supporting under adjustable tension one of said tensile sheet members form said stretcher frame;

second means for detachably supporting under adjustable tension said second tensile sheet embers from said stretcher frame whereby the patient is secured between said first and second tensile sheet members is trapped to said stretcher frame for rotation with said stretcher frame.

2. The invention of claim 1 wherein said means for detachably supporting said first and second tensile sheet members from said stretcher frame include loops on said first and second sheet and hooks and belts attached to said stretcher frame.

3. The invention of claim 2 wherein said belts are attached to said stretcher frame by buckles normally closing responsive to tensile loading of said belts.

4. The invention of claim 1 wherein said means for rotatably connecting said stretcher frame to said stretcher support includes a detent and said detent mechanism releasably holds said stretcher frame when said stretcher frame registers to a horizontal position.

5. The invention of claim 1 said means for rotatably connecting said stretcher frame to said stretcher support includes a brake.

6. The invention of claim 1 wherein said ram is hydraulic and includes an electrically powered hydraulic pressure source for raising and lowering said ram.

7. A method for lifting a patient lying on a a flat surface, transporting the patient and inverting the patient in preparation for treatment, comprising the step of:

providing a gurney having a base adapted to fit under the supporting legs of a hospital bed, said base having a plurality of wheels such that the gurney may be rolled from location to location;

providing a longitudinally elongate stretcher frame to receive and support a patient;

providing a stretcher frame support connected to said base with an expansible lifting apparatus therebetween whereby said stretcher frame support can be moved towards and away from said base;

rotatably attaching said stretcher frame to said stretcher frame support for rotating about an axis extending longitudinally of said longitudinally elongate stretcher frame only;

providing first and second tensile sheet members, each said tensile sheet member being sufficiently strong to support said patient from said stretcher frame under tension;

positioning said first tensile sheet member underneath a patient to be lifted on said flat surface;

rolling said gurney to a fist location of support beneath the flat surface such that the stretcher frame as mounted about said stretcher frame support registers about said patient and said sheet under said patient;

attaching under adjustable tension said first tensile sheet member to said stretcher frame;

lifting said stretcher frame relative to said base by expanding said lifting apparatus to elevate said patient above said bed;

disposing a second sheet member overlying the patient;

attaching under adjustable tension said second tensile sheet member from said frame whereby said patient is disposed between said first and second sheet members;

inverting said stretcher frame by rotating said stretcher frame relative to said stretcher frame support to invert said patient for support from said second tensile sheet member; and, removing said first sheet member with said patient supported on said second sheet member whereby said patient is inverted.

8. The method of claim 7 and including the further steps of:

lowering said patient to a table for support of said patient through said second sheet member on said table; and detaching said sheet from said frame member whereby said patient is supported in an inverted position on said table.

9. A gurney for moving a hospital patient between a hospital bed having spaced supporting legs and an operating table supported from a central pedestal base, which uses a first tensile sheet member and a second tensile sheet member to support and secure a patient to the gurney, each said tenisle sheet member being sufficiently strong to support a patient thereon when held under tension at the sides of said tensile sheet member, said gurney comprising:

a base, said base being horizontally disposed and U-shaped, said U-shaped base having spaced apart protruding arms connected by a central member, said spaced apart arms adapted to fit under and between the supporting legs of the hospital bed and straddle around the outside of the central pedestal base of the operating table;

said base supporting a plurality of wheels whereby said base can be rolled from support underneath the hospital bed to support around the central pedestal base of the operating table;

a stretcher support;

means for supporting said stretcher support rom said base including a lifting ram connected to the base at the lower end and to the stretcher support at the upper end whereby the stretcher support maybe raised and lowered with respect to the base;

a stretcher frame elongate about a central longitudinal axis, said stretcher frame disposed for surrounding and supporting a patient within said stretcher frame;

means for rotatably connecting said stretcher frame to said stretcher support at the longitudinal axis of said stretcher frame, said means for rotatably connecting said stretcher frame to said stretcher support permitting the rotation of said frame about said longitudinal axis between distal ends of said stretcher support;

first means for detachably supporting under adjustable tension one of said tensile sheets members from said frame;

second means for detachably supporting under adjustable tension said second tensile sheets members from said stretcher frame whereby the patient is secured between said first and second sheets and is trapped to said stretcher frame for rotation with said stretcher frame.

* * * * *